United States Patent [19]

Flora et al.

[11] 3,937,272

[45] Feb. 10, 1976

[54] COLD SET CATALYST SUPPLY AND FUME INCINERATOR FOR A FOUNDRY CORE MAKING MACHINE

[75] Inventors: Lawrence E. Flora, Bloomfield Hills; Billy G. DuBois, Linden, both of Mich.

[73] Assignee: Sutter Products Company, Holly, Mich.

[22] Filed: Oct. 29, 1973

[21] Appl. No.: 410,777

[52] U.S. Cl. ..... 164/159; 110/8 A; 164/16; 164/67; 164/259

[51] Int. Cl.[2] .. B22C 9/12; B22D 27/14; F23G 3/00

[58] Field of Search ..... 164/12, 166, 157, 228, 164/5, 7, 259, 159; 432/72; 110/8 A

[56] References Cited

UNITED STATES PATENTS

| | | | |
|---|---|---|---|
| 2,824,345 | 2/1958 | Zifferer | 164/157 X |
| 2,876,510 | 3/1959 | Zifferer | 164/7 X |
| 3,030,675 | 4/1962 | Chiabotti | 164/16 X |
| 3,038,221 | 6/1962 | Hansberg | 164/16 X |
| 3,248,178 | 4/1966 | Hoskinson | 432/72 X |
| 3,728,797 | 4/1973 | Worden | 110/8 A X |
| 3,787,171 | 1/1974 | Cromp | 432/72 |
| 3,795,726 | 3/1974 | Zifferer | 164/16 X |
| 3,837,813 | 9/1974 | Ebeling | 110/8 A X |

*Primary Examiner*—Francis S. Husar
*Assistant Examiner*—John S. Brown
*Attorney, Agent, or Firm*—Farley, Forster and Farley

[57] ABSTRACT

The apparatus comprises high pressure injection means for supplying during an accurately adjustable controlled cycle time an accurately adjustable controlled volume of atomized cold set catalyst into a high pressure dry air, nitrogen and/or $CO_2$ gas stream passing through the core box to cure the resin followed by a continuing air, nitrogen or $CO_2$ gas purging of the core box. The fumes from the core box are drawn through a natural gas or propane fired fume incinerator wherein an excess air-fuel mixture causes oxidation of the fumes during a controlled temperature and residence time. The fume incinerator operates continuously at a constant temperature under control by an automatic temperature sensor regardless of fume input and includes suction means to prevent back flow of gasses from the incinerator to the core box.

18 Claims, 6 Drawing Figures

118
M1
98
COMBINATION STARTER
126
120
120
124
OL'S
122
M1
108
LO-AIR
HI-LIMIT CONT.
114
128
1K1
2K2
1CR
SS
HEATER
1K4
2K3
133
2K1
T1
1K3
134
1K
SS
T2
92
2K
138
1K2
PILOT
LINK
TEST
JACK
ELECTRONIC
NETWORK
132
1CR
90
112
TC
THERMO COUPLE
TEMP.
CONTROLLER
110
135
INCINERATOR
UP TO TEMP.
116
TC
THERMO COUPLE
HI LIMIT
CONTROL
114

COLD SET CATALYST SUPPLY AND FUME INCINERATOR FOR A FOUNDRY CORE MAKING MACHINE

BACKGROUND OF THE INVENTION

The field of the invention pertains to foundry sand molding and core making with cold setting resins and in particular to the apparatus supplying catalyst to the core or mold box and for purging and oxidizing the fumes from the core box upon completion of the curing cycle to render them inert and harmless. Recent safety requirements prescribe that the cold setting resins and catalysts be safely and effectively provided to the core box on the molding machine and the fumes exhausted from the core box be consumed or oxidized to inert substances to thereby prevent toxic and noxious pollutants from entering the environment.

In earlier approaches to cold set curing, catalyst was supplied to the core box at relatively low pressure in the order of 25 psi which resulted in insufficient atomization and relatively long time periods for effecting a satisfactory cure with the generation of fumes from the core box. Earlier attempts at incineration of fumes involved unsatisfactory on and off cycling without adequate oxidation, speed of operation or protection against back leakage. Such prior art apparatus is therefore relatively slow and does not assure complete and continuous removal of noxious fumes.

SUMMARY OF THE INVENTION

The catalyst supply apparatus includes high pressure piston pump means which feeds on accurately adjustable volume of liquid cold set catalyst from a reservoir to a nozzle during an accurately adjustable limited time cycle. The nozzle atomizes and injects the catalyst into a high pressure nitrogen, air or $CO_2$ stream which in turn enters the core box to cure the core. The core is purged by the continuing supply of nitrogen, air or $CO_2$ air after the injection cycle for a sufficient time to drive off the toxic or noxious fumes and feed them to the fume incinerator. The incinerator includes aspirator-venturi means to provide a negative pressure relative to the core box and to mix the fumes with the air supplied to the fume incinerator. The toxic fumes are directed through a gas flame automatically controlled to provide a continuous combustion temperature of 1500° to 1600°F for complete oxidation of the toxic or noxious gasses without overheating or damage to the incinerator. The automatic control feeds propane or natural gas at a rate just sufficient to retain the proper combustion temperature regardless of fume input, thereby assuring that all fumes are completely oxidized despite the cyclic output of fumes from the core making process. The incinerator includes means to prevent backfire or return of exhaust fumes to the core box.

DESCRIPTION OF THE PREFERRED EMBODIMENT

Figure 1:
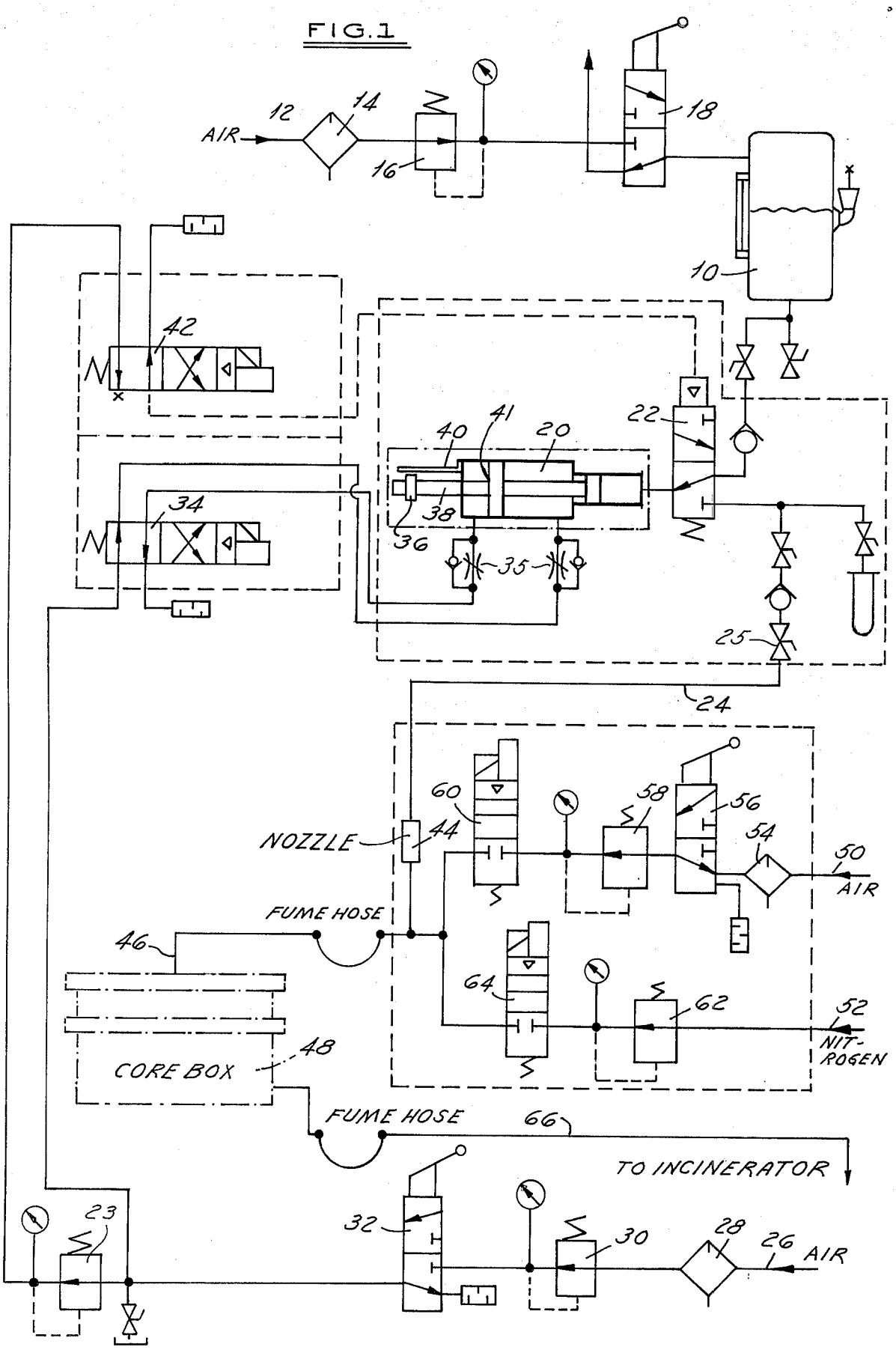
FIG. 1 is a schematic of the cold set catalyst supply system.
Figure 3:
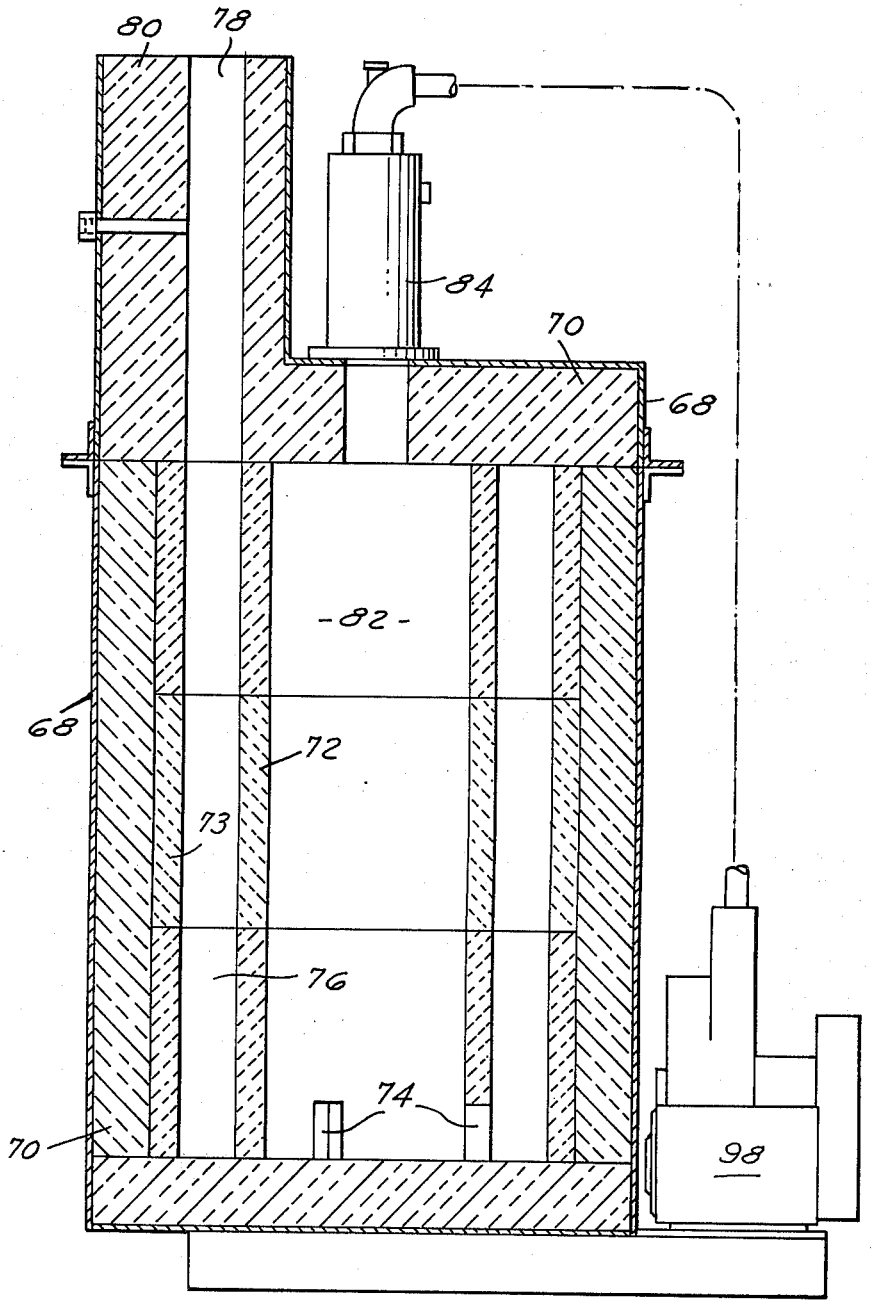
FIG. 3 is a side sectional view of the fume incinerator.
Figure 2:
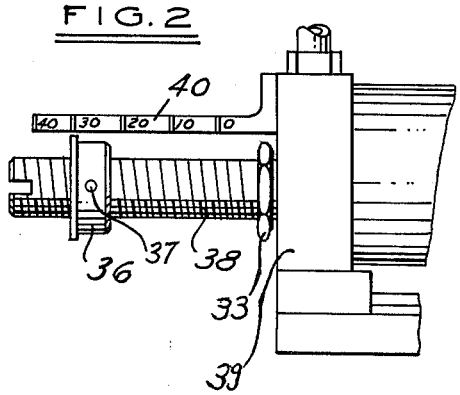
FIG. 2 is a partial side view of the pump of FIG. 1.
Figure 4:
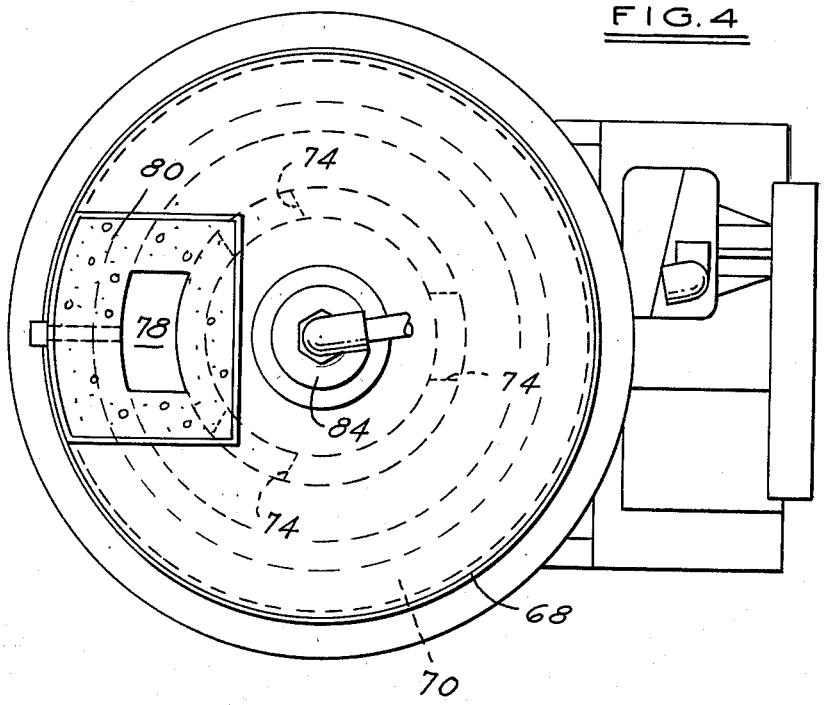
FIG. 4 is a top view of the fume incinerator.

In FIG. 1 a reservoir 10 is partially filled with a cold set catalyst such as triethylene or triethylamine and is pressurized by an air supply 12 including a filter 14 to eliminate moisture, pressure reducing valve 16 normally set at 15 psi, and lock out valve 18. The reservoir 10 feeds a pneumatic powered piston pump 20. An air piloted switching valve 22 alternatively provides for feeding from the reservoir 10 to the pump 20 and output from the pump 20 into the line 24. The pump has a 40 cc resin capacity and is designed to provide a 375 psi pump output pressure at 60 psi from the air supply 26. The pump air supply 26 includes a moisture filter 28, pressure reducer 30 normally set at 80 psi, and lock out valve 32. Solenoid controlled 2-position valve 34 and speed controls 35 control the reciprocating movement and duration of the pump piston stroke. As shown in FIG. 2, the pump 20 includes a threaded stop rod 38 threaded through the pump end 39 with an adjustable nut 33 and a collar 36 pinned at 37. A scale 40 is attached to the pump end 39. The stop rod 38 provides an adjustable limit per stroke by contacting the pneumatic piston at 41 on the return stroke. Thus, the pump capacity is adjusted by turning the stop rod 38 until the flange of the collar 36 coincides with the selected capacity on the scale 40 and the nut 33 is tightened against the end 39. The air piloted valve 22 is operated by the solenoid controlled valve 42 from air supplied through the pressure reducer 23 at 50 psi.

The outlet line 24 from the pump 20 feeds catalyst to an atomizing nozzle 44 which in turn injects the atomized catalyst into the high pressure gas supply line 46 leading to the core box 48. The outlet line 24 includes a needle valve 25 for adjusting the pressure drop to the fixed orifice nozzle 44. The core box gas supply line 46 may be alternately supplied with air from the air supply 50 for mixing with the atomized catalyst and/or with nitrogen from the nitrogen supply 52. Alternatively $CO_2$ may be substituted for the air or nitrogen. The air supply 50 includes moisture filter 54, lockout switch 56, pressure reducer 58 normally set at 100 psi and solenoid controlled purge valve 60. The nitrogen supply includes a pressure reducer 62 normally set at 100 psi and purge valve 64. The solenoid control valves 34, 42, 60 and 64 are connected into the conventional control circuitry of the core making machine to which this supply system is attached. Examples of such machines are the conventional single sided or double sided core making machines produced by Sutter Products Co. of Holly, Michigan.

The high pressure catalyst supply apparatus disclosed above is normally adjusted to provide catalyst at 200 psi into a 100 psi air stream. The nozzle orifice is selected to provide atomization to 60–90 microns. As a typical initial set up, the speed controls 35, needle valve 25 and pump adjustment collar 36 are set to provide 10 cc of catalyst into the 100 psi air stream in 5 seconds followed by a 15 second purge time with the nitrogen gas. The core is then checked and adjustments made as follows. Insufficient cure indicates a need for increased catalyst. A wet core indicates excess catalyst or insufficient purge time and may be corrected by decreasing the catalyst. An intense odor indicates a need for increased purge time.

Normally, a core will require 1–10 seconds for catalyst injection and 5–40 seconds for purging. The catalyst is provided in one stroke of the pump allowing a more accurate control of the catalyst quantity as adjusted to cores of different size and weight. The use of dry air or nitrogen with high pressure cold set catalyst injection eliminates the need for any heating of the core for effective curing. In addition to the above improvements, the applicants have noted more uniform cores with better shake out characteristics and more consistency in the depth of cure, density and surface definition.

The outlet line 66 from the core box 48 is connected to a fume incinerator shown in FIGS. 3 to 6. The fume incinerator comprises a cylindrical chamber 68 lined with a high temperature insulation such as a light weight insulating castable refractory 70. The interior of the incinerator is of two-pass construction having a central chamber 82 and annular chamber 76. An inner cylinder 72 of refractory includes exhaust ports 74 at the bottom thereof for communication to the annular chamber 76 from the central chamber 82. An exhaust flue 78 also lined with castable refractory 80 extends from the annular chamber 76 which is lined with refractory 73. The central chamber of the incinerator 82 is in communication with a fume heater 84 which suitably may comprise a burner such as an "Eclipse" burner modified for excess air capacity.

Figure 5:
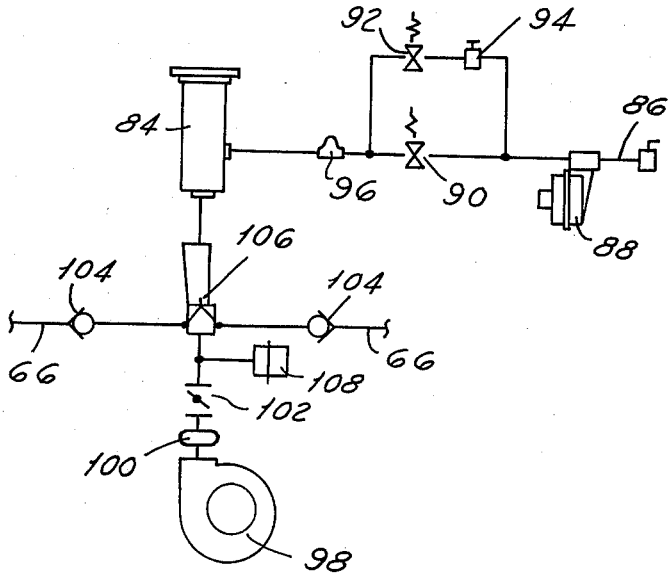
FIG. 5 is a schematic of the air and fuel supply to the fume incinerator.

The burner 84 as best shown in FIG. 5 is supplied with a gaseous fuel such as natural gas or propane at normal industrial pressures through an inlet supply 86, pressure regulator 88, main electric gas valve 90, and a final adjustable orifice 96. A pilot electric gas valve 92 and gas flow needle valve 94 are provided for startup of the incinerator. The air supply of 80–100 cfm for the burner 84 is provided by a small centrifugal blower 98, check valve 100 and manual butterfly valve 102. One or more core box exhaust inlets 66, including check valves 104 to prevent back flow are connected to a modified aspirator venturi 106 located at this point in the air supply for the burner 84. The aspirator venturi 106 is modified for the triple inlet and provided to assure mixing of the air and the fumes from the core box and to cause suction in lines 66. The burner 84 is operated with a substantial excess of air for combustion relative to the gas supply from 86 to assure that there is complete oxidation of the fumes aspirated into the burner 84. Triethylene, or other noxious or toxic fumes from the cold resin process pass through the flame front inside the burner and are completely oxidized.

Figure 6:
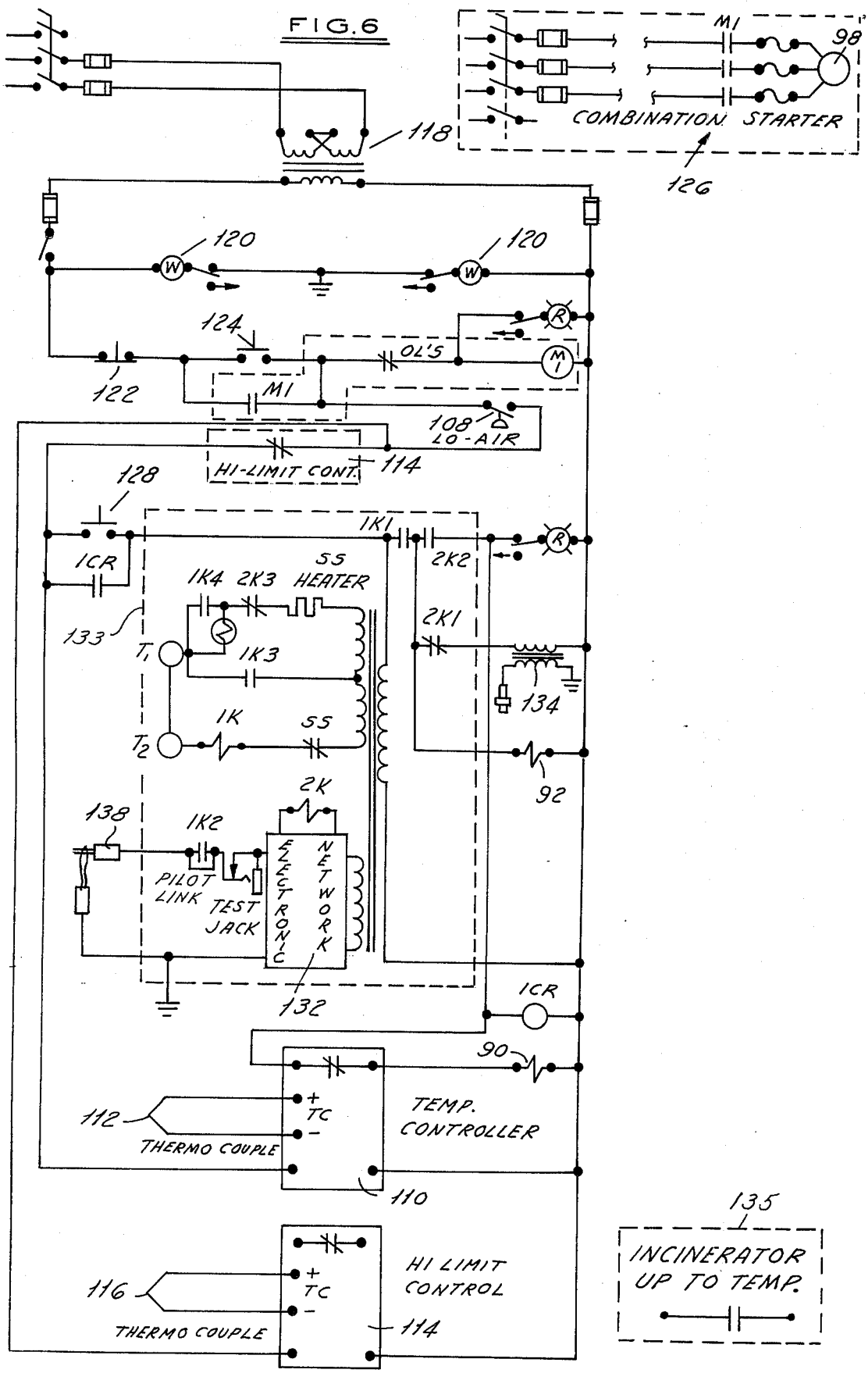
FIG. 6 is an electrical schematic of the fume incinerator.

The incinerator includes an electrical circuit shown in FIG. 6 for operation continuously with an automatic control to provide that the combustion temperature inside the incinerator remains substantially between 1500° and 1600° F without exceeding 1600°F regardless of the flow rate of fumes entering from the core making process. In order to assure the proper operation of the incinerator the electrical control circuit in FIG. 6 includes a Temperature Controller 110 which senses the output of a thermocouple 112 within the incinerator to thereby adjust the main gas valve 90. The Temperature Controller is normally set for an operating temperature between 1500° and 1600°F. In addition, a High Limit Control 114, also including a thermocouple 116 within the incinerator, shuts off the incinerator in the event that the combustion chamber therein exceeds a set level, normally 1600°F.

Power is derived from a 460 volt 3-phase alternating power source through the transformer 118. The circuit includes ground detection devices 120 and stop 122 and start 124 switches for the incinerator blower 98. The blower 98 is provided with separate 3-phase 460 volt power 126 as shown and is energized by the relay M-1 upon actuation of the start switch 124. The initial actuation of the blower purges the incinerator with fresh air before firing can be initiated. Actuation of the start switch 124 also energizes the circuit through the air pressure switch 108 and High Limit Control 114 as shown. Thus, failure of sufficient air from the blower or an over temperature in the incinerator will completely shut down the ignition and operational controls for the gas supply to the incinerator and prevent gas from entering through either the pilot valve 92 or main gas valve 90.

Subsequent to starting the blower the ignition switch 128 is actuated thus energizing a thermistor network 130 and electronic network 132. The thermistor network 130 actuates relay 1K to open the pilot valve 92 and energize the ignition transformer 134 and spark plug 136 thereby igniting the fume heater 84. Flame sensing means 138 upon a proven flame cause the electronic network 132 to energize the relay 2K which in turn disconnects the ignition transformer 134 and energizes the circuit to relay 1 CR and energizing the Temperature Controller 110. The Temperature Controller is set at the proper operating temperature which will be maintained regardless of the fume quantity drawn into the incinerator. The relay contacts indicated inside the dashed box 135 denote contacts that must be closed by the Temperature Controller before the core machine can initiate the curing cycle and are therefore tied into the core machine circuitry.

The check valves 104 in the lines 66 from the core boxes prevent backfire during the ignition procedure in the incinerator. An additional safety feature is the aspirator 106 which provides a negative pressure relative to the core box through the exhaust line 66 and check valve 104 to prevent backfire through the exhaust lines. The continuous operation of the aspirator and the incinerator assures that any leakage from the core box and line 66 will cause surrounding air to be drawn in thereby preventing leakage of toxic or noxious fumes from the apparatus.

The dimensions of the incinerator are determined to provide retention of the fumes for at least a one second minimum at 1500° – 1600°F before exhaust from the incinerator to assure complete oxidation of the noxious or toxic fumes. The exhaust from the incinerator may be expelled to the atmosphere inside or outside the enclosing building depending upon size relative to the incinerator output. The incinerator uses 10–12% of the fuel that would be required to heat the core box in prior art "hot box" processes and is capable of oxidizing two pounds per hour of toxic or noxious fumes from a double ended core blowing machine such as that produced by applicants' assignee Sutter Products.

We claim:

1. Production apparatus for making cold set foundry cores or articles comprising a pattern box adapted to receive fully enclosed cold set resin coated sand cores or articles, high super atmospheric pressure accurately adjustable liquid catalyst injection means adapted to repeatedly supply predetermined quantities of atomized liquid catalyst to said box, said injection means including controls adapted to actuate cyclically in coordination with the curing cycle of said apparatus, purging means adapted to purge fumes in coordination with said curing cycle from said box, and incineration means adapted to continuously draw fumes from said box and oxidize said fumes to inert substances.

2. The apparatus of claim 1 wherein said high pressure injection means include positive displacement liquid pumping means and nozzle atomizing means.

3. The apparatus of claim 2 wherein adjustable controls are provided for said injection means adapted to supply a predetermined quantity of catalyst over a specified time period to said atomizing nozzle means.

4. The apparatus of claim 3 wherein said pumping means comprises a piston pump having an adjustable pump stroke and adapted to make one high pressure supply stroke over said specified period.

5. The apparatus of claim 1 wherein said high pressure injection means includes a high pressure gas stream receiving said atomized liquid catalyst for injection into said box.

6. The apparatus of claim 5 wherein alternative dry air or nitrogen supply lines provide said high pressure gas stream.

7. The apparatus of claim 1 wherein said purging means includes means to continue injection of high pressure gas into said box subsequent to the injection of said catalyst.

8. The apparatus of claim 7 wherein said high pressure purging gas includes alternative sources of dry air or nitrogen.

9. The apparatus of claim 4 wherein said piston pump is driven by a pneumatic cylinder having speed controls connected thereto.

10. The apparatus of claim 2 wherein said high pressure injection means includes adjustable valve means between said pumping means and said nozzle means to control the flow rate of liquid catalyst.

11. The apparatus of claim 1 wherein said apparatus includes exhaust means from said box and said incinerator includes aspirator means in communication with said exhaust means adapted to continuously provide suction through said exhaust means.

12. The apparatus of claim 11 wherein said incinerator includes an air blower in communication with said aspirator and a burner in communication with said aspirator adapted to draw fumes from said exhaust means into the combustion air stream to said burner.

13. The apparatus of claim 12 wherein said incinerator includes dual combustion chambers communicating in sequential order with said burner.

14. The apparatus of claim 1 wherein said incinerator includes a fuel supply and an electric control, said electric control including a temperature control adapted to maintain a specific range of combustion temperatures within said incinerator by adjusting the fuel supply.

15. The apparatus of claim 14 wherein said electric control includes temperature limiting means to shut off operation of said incinerator in the event of an over temperature within said incinerator.

16. The apparatus of claim 14 wherein said temperature control includes under temperature means to prevent actuation of the curing process until the incinerator is within the specified temperature range.

17. The apparatus of claim 14 wherein said electric control includes air sensing means to prevent operation of said incinerator without sufficient excess combustion air.

18. The apparatus of claim 14 wherein said electric control includes continuous flame monitoring means.

* * * * *